US005788557A

United States Patent [19]

Pierre-Louis

[11] Patent Number: 5,788,557

[45] Date of Patent: Aug. 4, 1998

[54] CHILD'S ACTION TOY

[76] Inventor: Jean R. Pierre-Louis, 2801 NW. 9th Ave., Wilton Manors, Fla. 33311

[21] Appl. No.: 897,064

[22] Filed: Jul. 18, 1997

Related U.S. Application Data

[60] Provisional application No. 60/021,986 Jul. 18, 1996.

[51] Int. Cl.[6] ..... A63H 33/02

[52] U.S. Cl. ..... 446/450; 446/452

[58] Field of Search ..... 446/237, 238, 446/240, 243, 244, 266, 450–453; 472/7

[56] References Cited

U.S. PATENT DOCUMENTS 721,674 3/1903 Davis ..... 446/452

4,052,814 10/1977 Hall ..... 446/450

*Primary Examiner*—Robert A. Hafer
*Assistant Examiner*—Laura Fossum
*Attorney, Agent, or Firm*—Robert M. Downey, P.A.

[57] ABSTRACT

A child's action toy includes an elongate extension arm, adjustable in length, with a proximal end zone defining a handle and a wheel attachment brace at an opposite distal end zone, and a wheel assembly engaged by the brace and including a first outer wheel and a second, concentrically mounted inner wheel; the outer wheel being rotatable relative to the inner wheel. Decorative gear elements are rotatably driven about gear tracks on the inner wheel as the outer wheel rotates by holding the handle and using the elongate extension arm to push the wheel assembly along a ground surface.

6 Claims, 5 Drawing Sheets

CHILD'S ACTION TOY

This application claims the benifit of United States Provisional Application Ser. No. 60/021,981, filed Jul. 18, 1996.

BACKGROUND OF THE INVENTION

1. Field of the Invention

The present invention relates to action toys or amusement devices and, more specifically, the present invention relates to a wheel assembly with a plurality of decorative elements which rotate as the wheel assembly is pushed along a ground surface using an extension arm member.

2. Discussion of the Related Art

In the past, numerous action toys have been developed to entertain and amuse children. In particular, there have been various devices developed which incorporate an elongate handle which releasably attaches to a wheel, wherein a child runs while holding the elongate extension to push the wheel over the ground.

While these various devices in the related art have been found to be generally amusing, most children quickly become tired and bored with them. One reason for this is due to the fact that these toys, using a generally plain or conventional wheel design, lack attractive features which would capture the attention of children for any length of time.

Accordingly, there exists a need for a child's action toy which employs a number of attractive moving parts so as to make the toy more appealing to children.

SUMMARY OF THE INVENTION

A child's action toy includes an elongate extension arm, adjustable in length, with a proximal end zone defining a handle and a wheel attachment brace at an opposite distal end zone, and a wheel assembly engaged by the brace and including a first outer wheel and a second, concentrically mounted inner wheel; the outer wheel being rotatable relative to the inner wheel. Decorative gear elements are rotatably driven about gear tracks on the inner wheel as the outer wheel rotates by holding the handle and using the elongate extension arm to push the wheel assembly along a ground surface.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1A:
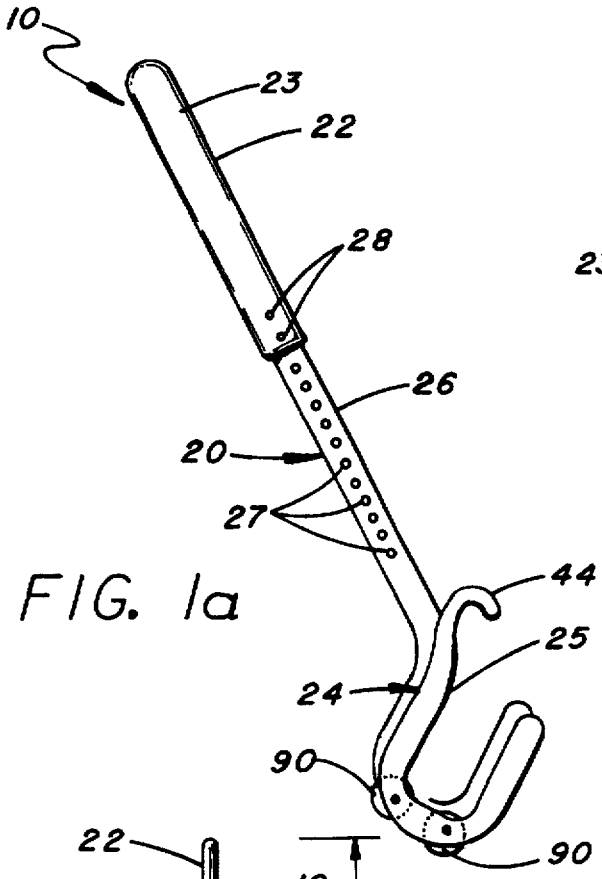
FIG. 1A is a side perspective view of the extension arm member and wheel attachment brace, shown with the handle in a fully extended position to define a maximum length of said extension arm member.

Referring to the several views of the drawings, the action toy device of the present invention is illustrated and generally indicated as 10.

The action toy device 10 includes an elongate extension arm 20 having a proximal end zone 22 defining handle means 23 for grasping with one's hands and a wheel engaging brace 24 on a distal end zone 25, opposite the handle means 23. The device further includes a wheel assembly 30 which is adapted to be operatively received and engaged within the wheel brace 24 so that by grasping the handle means 22, the wheel assembly 30 can be pushed along a ground surface.

Figure 1B:
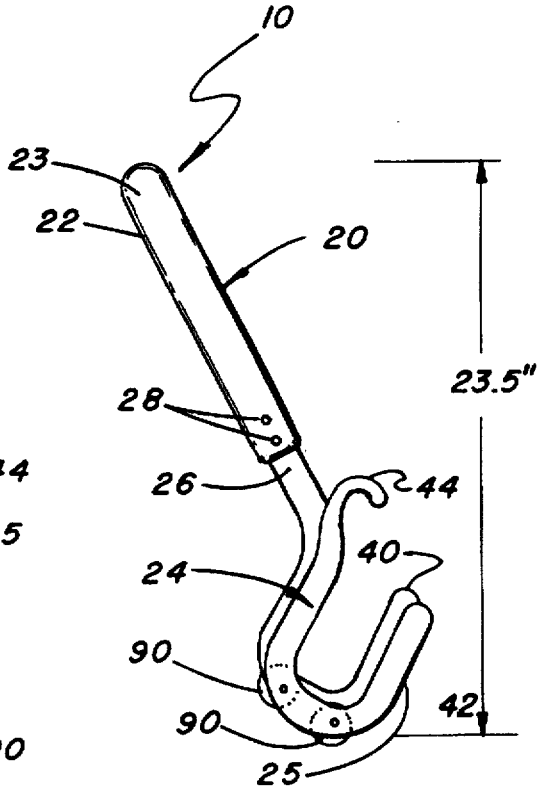
FIG. 1B is a side perspective view of the extension arm member and wheel attachment brace, shown with the handle in a retracted position to define a minimum length of said extension arm member.
Figure 2:
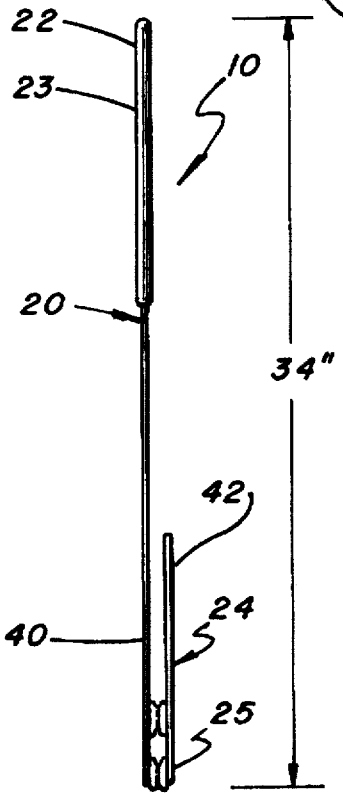
FIG. 2 is a rear elevational view of the extension arm member.

With specific reference to FIGS. 1A and 1B, the extension arm member 20 is shown with the handle means 23 in both a fully extended position and a collapsed position, respectively. The extension arm member 20 includes a main shaft 26 integral with and extending from the wheel brace 24. A plurality of apertures 27 formed at spaced intervals along at least a portion of the length of the shaft 26 are adapted for alignment with corresponding holes 28 formed in the handle means 23. To adjust the overall length of the extension arm 20, the handle means 23 is moved relative to the shaft 26 until the desired overall length of the extension arm member is achieved. By aligning the two holes 28 in the handle means 23 with a corresponding pair of apertures 27 along the shaft 26, the handle means 23 can be fixed in the selected adjusted position using conventional fasteners such as bolts and nuts which are received through the correspondingly aligned holes and apertures.

Figure 3:
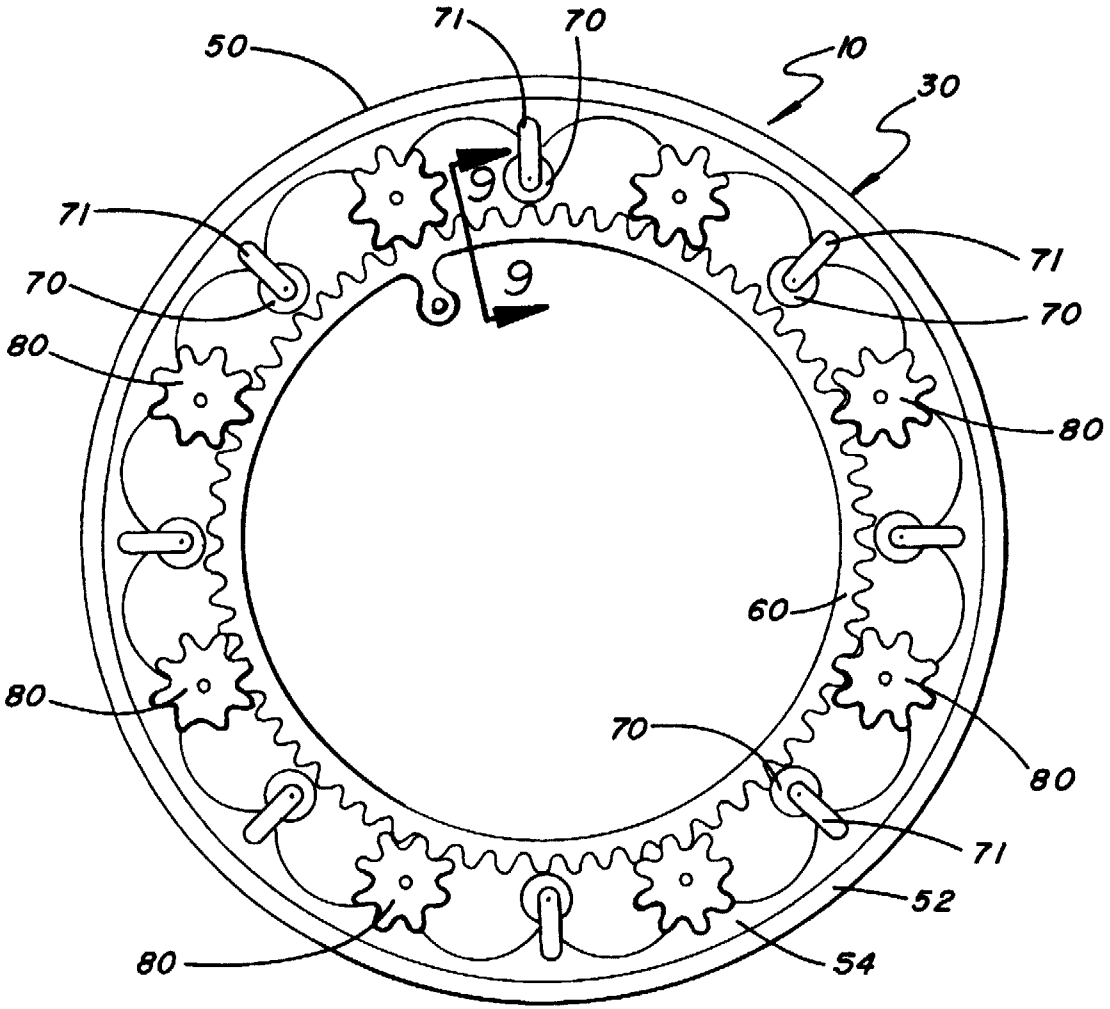
FIG. 3 is a side elevational view of the wheel assembly of the present invention.
Figure 4:
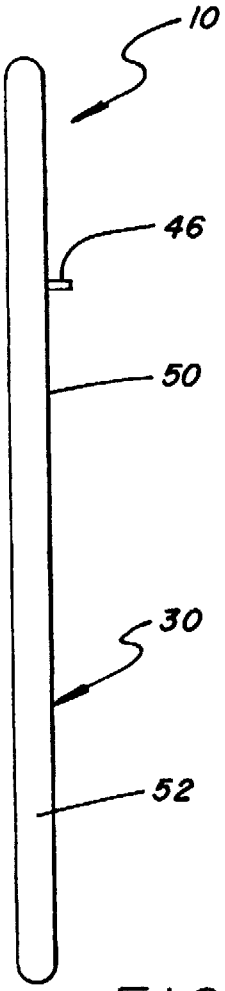
FIG. 4 is a front elevational view of the wheel assembly.
Figure 5:
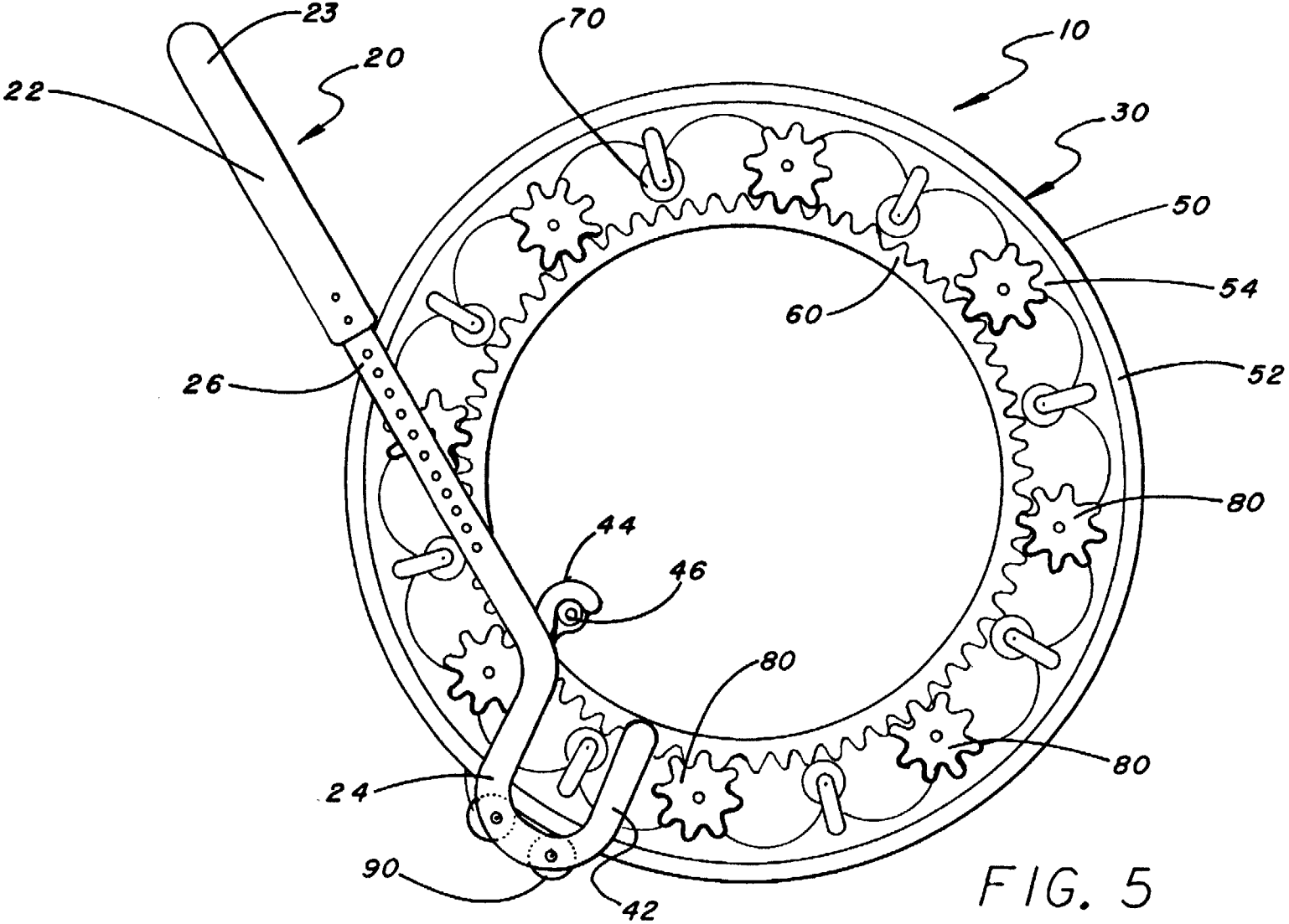
FIG. 5 is a side elevational view showing the wheel brace of the extension arm member in operative engagement with the wheel assembly.
Figure 6:
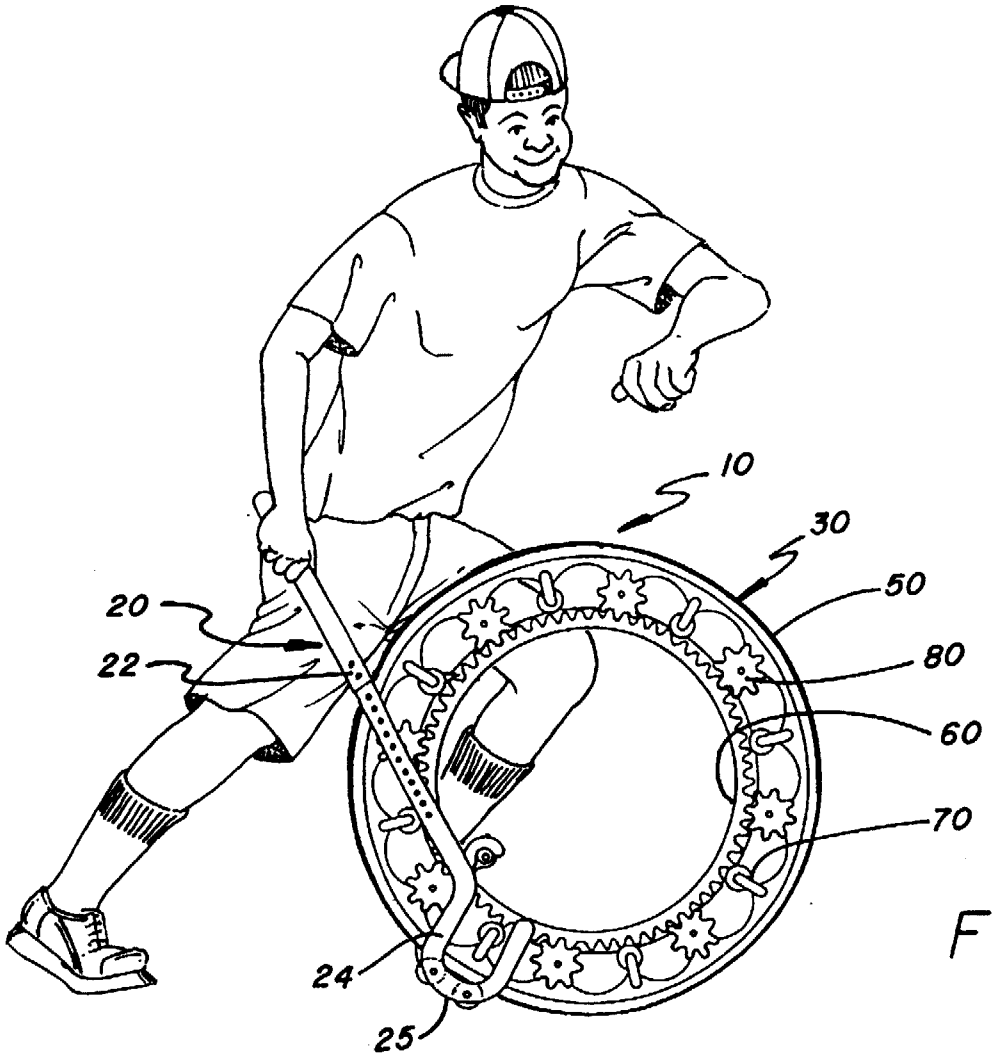
FIG. 6 is a side perspective view showing a person using the action toy of the present invention, wherein the wheel assembly is pushed along a floor surface.
Figure 7:
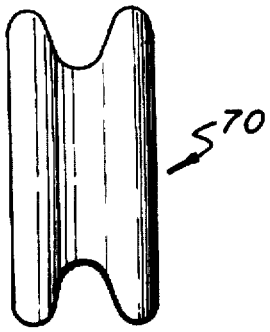
FIG. 7 is an isolated front elevational view of a roller element of the wheel assembly.
Figure 8:
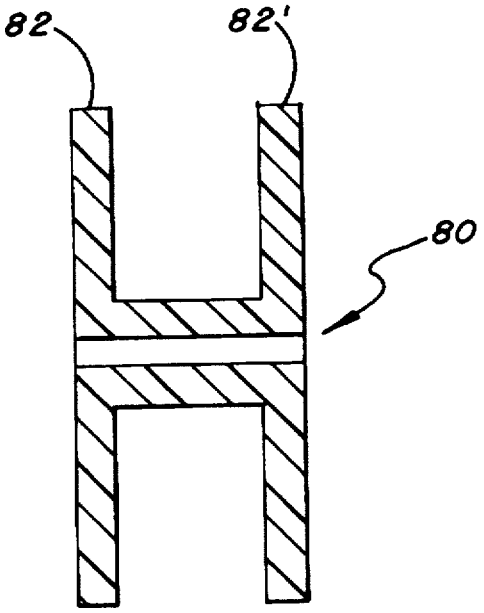
FIG. 8 is an isolated front elevational view of a gear pair of the wheel assembly.
Figure 9:
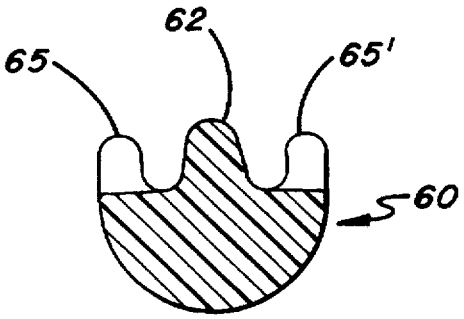
FIG. 9 is a sectional view taken along line 9—9 of FIG. 3 showing a cross section of the inner wheel.

The wheel engaging brace 24 includes a pair of spaced members 40, 42 which are structured to straddle opposite sides of the wheel assembly 30, as seen in FIG. 3. One of the brace members, such as 42, includes an upper hook member 44 structured to engage a protruding peg 46 on the wheel assembly 30.

The wheel assembly 30 includes a first outer wheel 50 and a second, concentrically supported inner wheel 60. The outer wheel 50 is rotatable relative to the inner wheel 60 and includes an annular rim 52 which engages the floor surface and rolls along the floor surface as the wheel assembly is pushed. The outer wheel 50 further includes an inwardly directed radial flange 54 which is coplanar with a central plane of the wheel assembly 30. The inner wheel 60 includes an annular central rail 62 about its outer circumference and coplanar with the central plane. The central rail 62 is structured and disposed for operative, captivated and rolling engagement with a plurality of first decorative rotating elements 70 defining bearings. The outer circumference of the inner wheel 60 is further provided with gear teeth 64 on opposite sides of the central rail to provide outboard gear tracks 65, 65' which are structured for driven engagement with a plurality of gear pairs 80, defining second decorative rotating elements. Both the plurality of first decorative rotating elements 70 and the plurality of second decorative rotating elements 80 are rotatably mounted to the outer rim 50 so that they are positioned between the outer rim 50 and the inner rim 60.

The inner wheel 60 is maintained within the outer wheel 50 by the bearings 70 which are rotatably fitted on brackets 71 secured to the radial flange 54 at spaced intervals thereabout. The gear pairs 80 are also rotatably fitted to the outer wheel 50 on axles or pins which fit through the radial flange 54 to rotatably support first and second gear elements 82, 82' on opposite sides of the central plane of the wheel assembly for engagement with a respective one of the gear tracks 65, 65' so that the gear elements 82, 82' travel about the respective gear tracks 65, 65' as the outer wheel 50 rotates relative to the inner wheel 60.

The protruding peg 46 on the inner rim 60 is specifically structured and disposed for engagement with the hook member 44 when the wheel assembly 30 is fitted within the wheel brace 24 so that upon causing the annular rim 52 of the outer wheel 50 to be rolled on a ground surface by pushing with the extension arm 20, the inner wheel 60 is maintained stationary relative to the outer wheel. Because the outer wheel 50 is rotating and the inner wheel 60 is stationary, the decorative elements 70 and 80 are caused to rotate and revolve about the outer circumference of the inner rim 60, thereby providing an attractive and amusing effect.

The wheel engaging brace 24 includes rollers 90, 92 rotatably mounted between the brace members 40, 42. Roller 92 engages the annular rim 52 and stabilizes the wheel assembly. Roller 90 engages the ground surface and rolls therealong as the handle is used to push the wheel assembly, thereby reducing friction and providing more stability to the device 10.

While the instant invention has been shown and described in what is considered to be a preferred and practical embodiment thereof, it is recognized that departures may be made within the spirit and scope of the present invention which, therefore, should not be limited except as defined by the following claims as interpreted under the doctrine of equivalents.

Now that the invention has been described,

What is claimed is:

1. An action toy comprising:

a wheel assembly having a central plane perpendicular to an axis of rotation and including:

an outer wheel including an annular rim for engagement with a floor surface and an inwardly directed radial flange on said central plane;

an inner wheel maintained in concentric position relative to said outer wheel in axial alignment with said axis of rotation, said inner wheel including a central rail coplanar with said radial flange of said outer wheel on said central plane, and first and second annular gear tracks spaced outward of said central rail on opposite sides thereof respectively;

a plurality of roller elements rotatably fitted to said radial flange of said outer wheel at spaced intervals thereabout, each of said roller elements including an annular groove structured and disposed for rolling, captivating engagement of said central rail of said inner wheel to maintain said inner wheel in said concentric position and allowing rotation of said outer wheel relative to said inner wheel;

a plurality of gear pairs rotatably fitted to said radial flange of said outer wheel, each of said gear pairs including first and second gear elements disposed in driven, intermeshing engagement with a respective one of said first and second annular gear tracks, wherein rotation of said outer wheel relative to said inner wheel results in travel of said gear elements about said annular gear tracks; and means for rolling said wheel assembly along a floor surface including:

an elongate arm member having a proximal end zone and a distal end zone;

handle means on said proximal end zone for grasping said elongate arm member;

a wheel support brace for removably receiving said wheel assembly in a generally upright position defined by said central plane being generally perpendicular to the floor surface, wherein forward movement of said arm member, while said annular rim of said outer wheel remains in engagement with the floor surface and said wheel assembly remains received within said wheel support brace, results in rolling of said wheel assembly along the floor surface;

means on said wheel support brace for guiding rotation of said outer wheel as said wheel assembly is rolled along the floor surface; and means on said wheel support brace for holding said inner wheel from rotating while said outer wheel is rolled along the floor surface.

2. An action toy as recited in claim 1 wherein said elongate arm member includes extension means for selectively adjusting a length of said elongate arm member measured between said proximal and distal end zones.

3. An action toy as recited in claim 1 wherein said means for guiding rotation of said outer wheel includes a guide roller rotatably supported on said wheel support brace.

4. An action toy as recited in claim 1 wherein said means for holding said inner wheel from rotating include a hook member on said wheel support brace and a protruding peg on said inner wheel, said hook member being structured to removably captivate said peg upon forward movement of said elongate arm member.

5. An action toy as recited in claim 1 wherein said handle means is movable relative to said elongate arm member to selectively adjust an overall length of said elongate arm member measured between said proximal and distal end zones.

6. An action toy as recited in claim 1 wherein said wheel support brace includes a roller rotatably fitted thereto for rolling engagement with the floor surface upon forward movement of said elongate arm member.

* * * * *